US005955186A

United States Patent [19]

Grab

[11] Patent Number: 5,955,186

[45] **Date of Patent: *Sep. 21, 1999**

[54] COATED CUTTING INSERT WITH A C POROSITY SUBSTRATE HAVING NON-STRATIFIED SURFACE BINDER ENRICHMENT

[75] Inventor: George P. Grab, Greensburg, Pa.

[73] Assignee: Kennametal Inc., Latrobe, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/732,571

[22] Filed: Oct. 15, 1996

[51] Int. Cl.[6] ..... C23C 9/00

[52] U.S. Cl. ..... 428/312.8; 51/295; 51/307; 51/309; 428/212; 428/336; 428/472; 428/698; 428/697; 428/699; 428/701; 428/702; 428/310.5; 428/312.2; 428/318.4; 428/319.1; 428/551; 428/552; 428/565; 428/610; 407/119

[58] Field of Search ..... 428/469, 472, 428/698, 336, 212, 697, 699, 701, 702, 310.5, 312.2, 312.8, 318.4, 319.1, 551, 552, 565, 610; 51/295, 307, 309; 407/119

[56] References Cited

U.S. PATENT DOCUMENTS

| | | | |
|---|---|---|---|
| 3,909,895 | 10/1975 | Abrahamson et al. | 29/95 A |
| 4,035,541 | 7/1977 | Smith et al. | 428/217 |
| 4,277,283 | 7/1981 | Tobioka et al. | 75/238 |
| 4,548,786 | 10/1985 | Yohe . | |
| 4,610,931 | 9/1986 | Nemeth et al. | 428/547 |
| 4,743,515 | 5/1988 | Fischer et al. | 428/698 |
| 4,812,370 | 3/1989 | Okada et al. . | |
| 4,830,930 | 5/1989 | Taniguchi et al. | 428/547 |
| 5,066,553 | 11/1991 | Yoshimura et al. . | |
| 5,181,953 | 1/1993 | Nakano et al. . | |
| 5,250,367 | 10/1993 | Santhanam et al. | 428/698 |
| 5,266,388 | 11/1993 | Santhanam et al. | 428/212 |
| 5,283,030 | 2/1994 | Nakano et al. | 419/53 |
| 5,288,676 | 2/1994 | Shimada et al. . | |
| 5,310,605 | 5/1994 | Baldoni, II et al. . | |
| 5,372,873 | 12/1994 | Yoshimura et al. | 428/216 |

(List continued on next page.)

FOREIGN PATENT DOCUMENTS 54-87719 7/1979 Japan .

OTHER PUBLICATIONS

Taniguichi et al., "The β–Free Layer Formed Near the Surface of Sintered WC–β–Co Alloy Containing Nitrogen," Preliminary Publication at 1980 Autumn Meeting of the Japan Society of Powder and Powder Metallurgy Association, pp. 18–19.

Suzuki et al., "The β–Free Layer Formed Near the Surface of Sintered WC–β–Co Alloy Containing Nitrogen," The Journal of the Japan Institute of Metals, vol. 45, No. 1, (1981) pp. 95–99.

Suzuki et al., "The β–Free Layer Formed Near the Surface of Vacuum–Sintered WC–β–Co Alloys Containing Nitrogen," Transactions of the Japan Institute of Metals, vol. 23, No. 11, (1981), pp. 758–764.

Nemeth et al., "The Microstructure Features and Cutting Performance of the High Edge Strength Kennametal Grade KC850®," Proc. Tenth Plansee Seminar, Metalwerke Plansee A.G., Reutte, Tyrol, Austria, (1981), pp. 613–627.

Kobori et al., "Binder Enriched Layer Formed Near the Surface of Cemented Carbide," Funtai oyobi Funtai Yakin, vol. 34, No. 3, (1987), pp. 129–132.

*Primary Examiner*—A. A. Turner
*Attorney, Agent, or Firm*—John J. Prizzi

[57] ABSTRACT

A cutting insert which comprises a rake face and a flank face wherein there is a cutting edge at the juncture of the rake face and the flank face. The cutting insert has a coating and a substrate wherein the coating is adherently bonded to the substrate. The substrate is a tungsten carbide-based cemented carbide wherein there is a zone of non-stratified cobalt enrichment beginning near and extending inwardly from a peripheral surface of the substrate. The bulk substrate has a porosity of greater than C00 and less than or equal to C02.

28 Claims, 2 Drawing Sheets

U.S. PATENT DOCUMENTS 5,374,471 12/1994 Yoshimura et al. .
5,380,408 1/1995 Svensson ..... 204/129
5,447,549 9/1995 Yoshimura .
5,451,469 9/1995 Gustafson et al. ..... 428/548
5,484,468 1/1996 Östlund et al. ..... 75/236
5,494,635 2/1996 Bennett ..... 419/14
5,549,980 8/1996 Ostlund et al. .
5,576,093 11/1996 Yoshimura et al. .
5,649,279 7/1997 Gustafson et al. .
5,681,651 10/1997 Yoshimura et al. .
5,729,823 3/1998 Gustafson et al. .

COATED CUTTING INSERT WITH A C POROSITY SUBSTRATE HAVING NON-STRATIFIED SURFACE BINDER ENRICHMENT

BACKGROUND

The invention concerns a coated cemented carbide cutting insert that has a substrate with a porosity (per the ASTM Designation B 276-86, entitled "Standard Test Method for Apparent Porosity in Cemented Carbides") of greater than C00 and less than or equal to C02 wherein there is a zone of non-stratified, i.e., generally homogeneous, binder enrichment beginning near and extending inwardly from a peripheral surface of the substrate.

Heretofore, there has been the Kennametal KC850® coated cutting insert (KC850 is a registered trademark of Kennametal Inc., of Latrobe, Pa. 15650, USA, for cutting inserts) which has a C03/C05 porosity substrate which has a zone of surface binder enrichment. This binder enrichment is a stratified type of binder enrichment meaning that the binder enrichment forms in distinct layers of binder metal. The Nemeth et al. article, "The Microstructural Features and Cutting Performance of the High Edge Strength Kennametal Grade KC850," Proceedings of Tenth Plansee Seminar, Reutte, Tyrol, Austria, Metalwerke Plansee A. G. (1981), pp. 613–627, describes the "Kennametal KC850®" coated cutting tool (or insert). The "Kennametal KC850®" coated cutting insert has a tri-phase coating of TiC-TiCN-TiN, according to U.S. Pat. No. 4,035,541, to Smith et al., entitled "Sintered Cemented Carbide Body Coated with Three Layers."

SUMMARY

The invention is a cutting insert which comprises a rake face and a flank face wherein there is a cutting edge at the juncture of the rake face and the flank face. The cutting insert has a coating and a substrate wherein the coating is adherently bonded to the substrate. The substrate is a tungsten carbide-based cemented carbide which has a bulk composition of between about 3 to about 12 weight percent cobalt, up to about 12 weight percent tantalum, up to about 6 weight percent niobium, up to about 10 weight percent titanium, and the balance tungsten and carbon. There is a zone of non-stratified cobalt enrichment beginning near and extending inwardly from a peripheral surface of the substrate. The zone of non-stratified enrichment has A porosity. The bulk substrate has a porosity of greater than C00 and less than or equal to C02.

BRIEF DESCRIPTION OF THE DRAWINGS

The following is a brief description of the drawings which form a part of this patent application.

DETAILED DESCRIPTION

Figure 1:
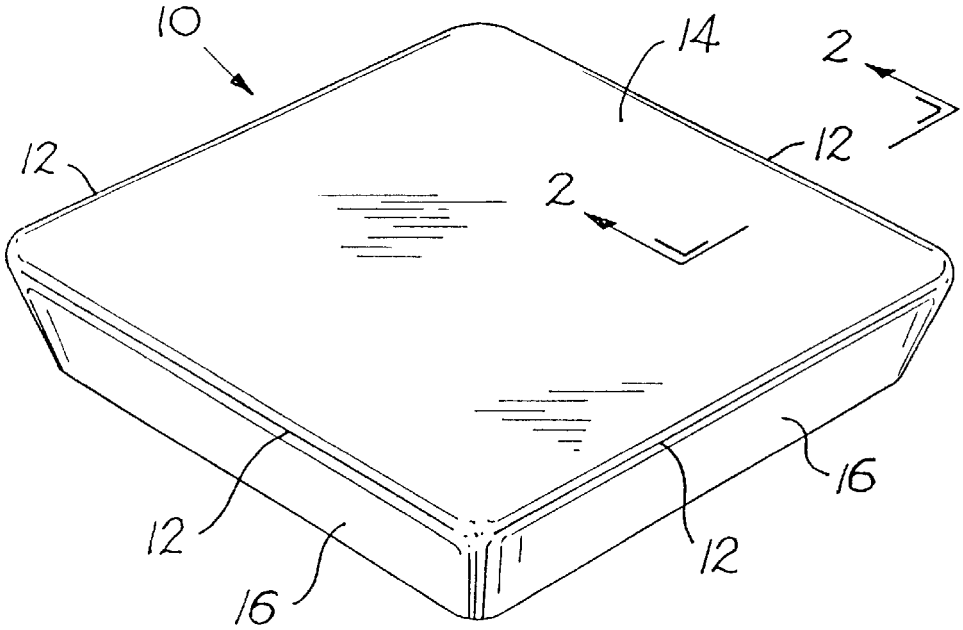
FIG. 1 is an isometric view of a specific embodiment of an SPGN 432 style of cutting insert.

Referring to the drawing figures, FIG. 1 illustrates a specific embodiment of the present invention as an indexable cutting insert generally designated as 10. Cutting insert

10 has cutting edges 12 at the junction of the rake face 14 with the flank faces 16. Although the cutting insert 10 shown in FIG. 1 is an SPGN 432 style with a honed cutting edge, applicant contemplates that the present invention includes other styles of cutting inserts with or without honed cutting edges.

Figure 2:
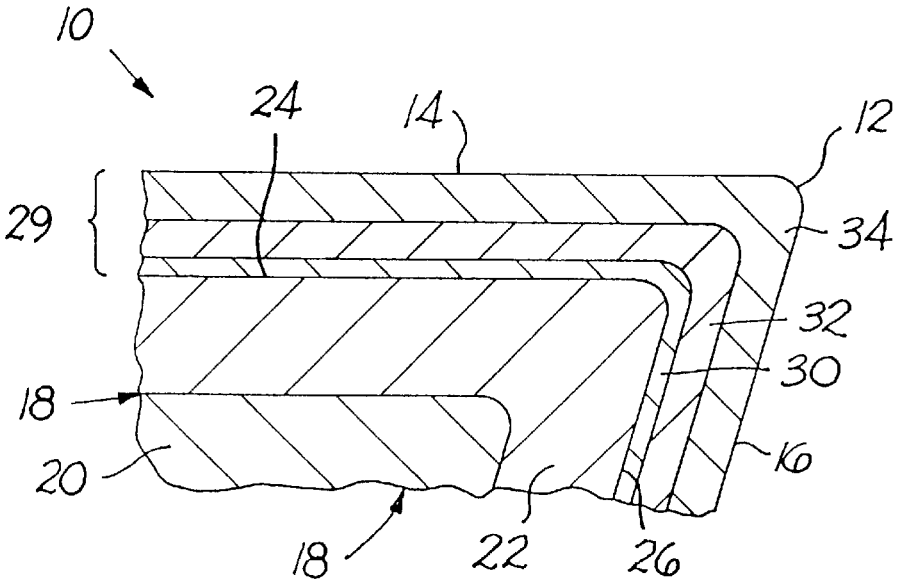
FIG. 2 is a cross-sectional view of the cutting insert illustrated in FIG. 1 taken along section line 2—2.

FIG. 2 shows a cross section at the cutting edge 12 of cutting insert 10 taken along section 2—2 of FIG. 1. The substrate generally designated as 18 has a non-binder enriched zone 20, i.e., a zone comprising the central portion (or bulk region) of the substrate, and an outer (or peripheral) binder enriched zone 22 near the peripheral boundaries 24 and 26 of the substrate. The outer binder enriched zone 22 exhibits a non-stratified type of binder enrichment. In other words, the binder enriched zone 22 is generally homogeneous in nature. This is in distinction to a zone of stratified binder enrichment in which the binder forms as layers one on top of the-other such as discussed in Kobori et al., entitled "Binder Enriched Layer Formed Near the Surface of Cemented Carbide," Powder and Powder Metallurgy, Vol. 34, No. 3, pp. 129–133 (April 1987).

In a preferred embodiment, the substrate 18 is a tungsten carbide based cemented carbide substrate containing at least 70 weight percent tungsten carbide, and more preferably, at least 80 weight percent tungsten carbide. The binder is preferably cobalt or a cobalt alloy and, preferably, has a bulk concentration of 3 to 12 weight percent. The more preferable bulk cobalt content is between about 5 to about 8 weight percent. Even more preferably, the bulk cobalt content is between about 5.6 to about 7.5 weight percent.

The substrate 18 also contains solid solution carbide and/or carbonitride forming elements such as titanium, hafnium, zirconium, niobium, tantalum and vanadium, with these elements being preferably selected from titanium, niobium and tantalum, either alone or in combination with each other or tungsten. These elements preferably may be added to the mix as a carbide, nitride and/or carbonitride, and more preferably as a nitride, and most preferably, as tantalum (niobium) carbide and titanium nitride. Preferably, the concentration of these elements is within the following ranges: up to 12 weight percent tantalum, up to 10 weight percent titanium, and up to 4 weight percent niobium. More preferably, the sum of the tantalum content and the niobium content is between about 3 and about 7 weight percent and the titanium content is between about 0.5 and about 5 weight percent. Most preferably, the sum of the tantalum content and the niobium content is between about 5.0 and about 5.9 weight percent, and the titanium content is between about 1.7 and about 2.3 weight percent.

In the bulk region 20 of the substrate 18, these elements (i.e., titanium, hafnium, zirconium, niobium, tantalum and vanadium) form, at least to some extent and preferably for the most part, solid solution carbides and/or solid solution carbonitrides with the tungsten carbide in the substrate. In the enriched zone 22, the solid solution carbides and/or carbonitrides have been wholly, or partially, depleted so that tungsten carbide and cobalt comprise the majority of the composition of the binder enriched zone 22.

Within the binder enriched zone 22, the binder (e.g., cobalt) content should reach a maximum value which is between about 125 to about 300 percent. A more preferable range of binder enrichment is between about 150 and about 300 percent of the bulk binder content. The most preferable range of binder enrichment is between about 200 and about 300 percent of the bulk cobalt concentration in the substrate.

The binder enriched zone 22 preferably extends to the substrate peripheral surfaces 24 and 26. In the alternative, there may be a thin layer adjacent to these peripheral boundaries (24, 26) in which cobalt content has been reduced due to evaporation during substrate sintering so that the zone of binder (e.g., cobalt) enrichment 22 extends to near the peripheral surface (24, 26) of the substrate 18. The thickness of the binder enriched zone is preferably up to about 50 micrometers ($\mu$m).

Bonded onto the peripheral boundaries 24 and 26 of the substrate 18 is a hard coating, designated by brackets as 29, preferably having one or more layers applied by chemical vapor deposition (CVD) or a combination of CVD and physical vapor deposition (PVD) techniques. MTCVD (medium temperature CVD) techniques may be used to apply a layer, such as a titanium carbonitride layer. These layers may comprise a base layer 30, an intermediate layer 32, and an outer layer 34. Although FIG. 2 illustrates the layers as having different thicknesses, it should be appreciated that is for illustrative purposes only. The thickness of each layer (30, 32, 34) depends upon the specific application for the cutting insert.

The base layer 30 is deposited directly onto the surface (24, 26) of the substrate 18. The thickness of the base layer 30 preferably varies between about 3 micrometers ($\mu$m) and about 6 $\mu$m. While the composition of the base layer can vary, preferred compositions may include, for example, titanium carbide, titanium carbonitride, and titanium nitride. The intermediate layer 32 is deposited directly onto the surface of the base layer 30. The thickness of the intermediate layer 32 varies between about 2 $\mu$m and about 5 $\mu$m. While the compositions of the intermediate layer(s) can vary, preferred compositions may include titanium carbonitride, titanium nitride, titanium carbide, alumina, titanium aluminum nitride and their combinations. The outer layer 34 is deposited directly onto the surface of the intermediate layer 32. The thickness of the outer layer 34 varies between about 1.5 $\mu$m and about 4 $\mu$m. While the composition of the outer layer can vary, preferred compositions may include titanium nitride, titanium carbonitride, titanium aluminum nitride, and alumina.

While the above description mentions suitable candidates for the coating layers, the preferred coating scheme uses a base coating of titanium carbide, an intermediate coating of titanium carbonitride, and an outer coating of titanium nitride.

U.S. Pat. No. 4,035,541, to Smith et al., discloses a three layer coating that is applicable to the cutting insert illustrated in FIG. 2. In addition, the coating scheme may be applied by a combination of CVD and PVD, such as those processes described in U.S. Pat. No. 5,250,367, to Santhanam et al., for a "Binder Enriched CVD and PVD Coated Cutting Insert," and U.S. Pat. No. 5,266,388, to Santhanam et al., for a "Binder Enriched Coated Cutting Insert." Applicant hereby incorporates U.S. Pat. No. 4,035,541, to Smith et al., U.S. Pat. No. 5,250,367, to Santhanam et al., and U.S. Pat. No. 5,266,388, to Santhanam et al., by reference herein.

As shown in FIG. 2, for a cutting insert used in milling applications, it is preferred that the binder enriched zone 22 be present underneath peripheral boundaries which lie parallel to the rake face 14 and flank faces 16 of the cutting insert 10. In other applications such as, for example, turning, it is contemplated that the enriched zone would be present under only the rake face with the zone of enrichment having been removed (e.g., by grinding) from the other faces. In this regard, the cutting insert 40 depicted in FIGS. 3 and 4, which is an SNG 433 style of cutting insert, presents a microstructure in which the enriched zone is present only under the rake faces.

Figure 3:
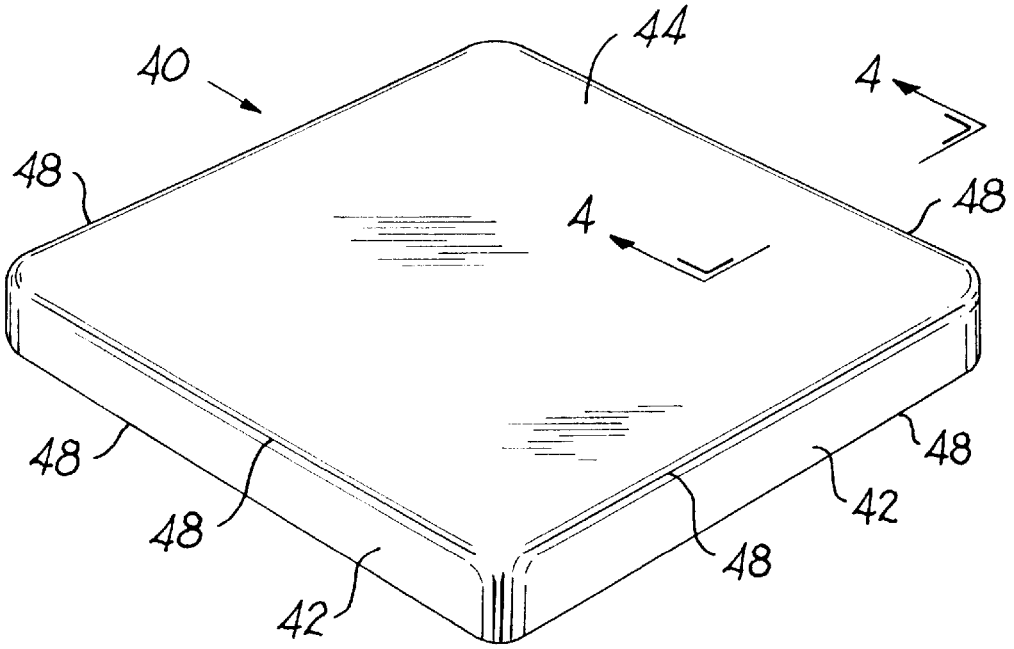
FIG. 3 is an isometric view of a specific embodiment of an SNG 433 style of cutting insert.
Figure 4:
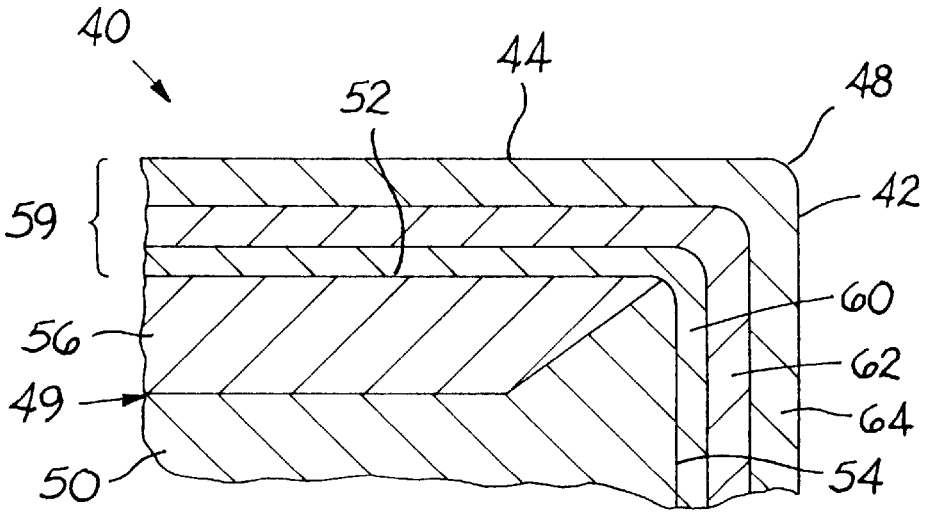
FIG. 4 is a cross-sectional view of the cutting insert illustrated in FIG. 3 taken along section line 4—4.

Referring to FIGS. 3 and 4, cutting insert 40 has four flank faces 42 which intersect with one rake face 44 and another rake face (not illustrated) opposite from the one rake face 44 so as to form eight cutting edges 48. Cutting insert 40 has a substrate generally designated as 49 with peripheral boundary 52 at the rake face and a peripheral boundary 54 at the flank face. The substrate 49 has a bulk portion 50 which comprises the majority of the substrate 49, and a layer of binder enrichment 56 near the peripheral boundary 52 at the rake face. Binder enrichment is absent from the bulk portion 49 including the volume near the peripheral boundary 54.

The substrate 49 for cutting insert 40 is of essentially the same composition as that for cutting insert 10. The levels of binder enrichment are also essentially the same for cutting insert 40 as those for cutting insert 10. The basic coating scheme (shown in brackets as 59) is also essentially the same for cutting insert 40 as for cutting insert 10. In this regard, cutting insert 40 has a base coating layer 60, an intermediate coating layer 62, and an outer coating layer 64.

The present invention is further described by the following example which is provided solely for the purpose of description, and is not intended to limit the scope of the invention. Inventive Example No. 1 is set forth in conjunction with Comparative Examples Nos. 1 through 3.

For the inventive and the comparative examples, the substrate powders contained about 5.8 weight percent cobalt, about 5.2 weight percent tantalum, about 2.0 weight percent titanium, and the balance was tungsten and carbon. The titanium was added in the form of titanium nitride. The tantalum was added in the form of tantalum carbide. The tungsten was added as tungsten carbide and tungsten and the carbon was added in the form of tungsten metal and carbon black. The mixes were charged to various levels of carbon as set forth in Table I below.

TABLE I

Levels of charged Carbon in the Examples

| Example | Comparative Example No. 1 | Comparative Example No. 2 | Comparative Example No. 3 | Inventive Example No. 1 |
|---|---|---|---|---|
| Charged Carbon (wt. %) | 5.92 | 5.98 | 6.01 | 5.95 |

The 5 kilograms (kg) of the mix charge for each example was added to a 7.5 inch inside diameter by 9 inch steel mill jar along with 21 kg of ⅜ inch diameter cemented carbide cycloids and heptane to the top of the jar. The mix was rotated for 40 hours at 52 revolutions per minute (rpm) at ambient temperature. The slurry from each charge was dried, paraffin added as a fugitive binder, and the powders were granulated so as to provide for adequate flow properties. The granulated powders were pressed into SNG433 style cutting insert blanks and sintered at 2650° F. (1456° C.) for about 30 minutes under a vacuum. These cutting insert substrates were then allowed to furnace cool.

The rake faces were then ground and the cutting insert blanks reheated at 2650° F. (1456° C.) for about 60 minutes under a vacuum followed by a controlled cool down of 100° F. (56° C.)/hour until reaching 2100° F. (1149° C.). Table II below presents properties of the resultant substrates after reheating.

TABLE II

Compositions and Physical Properties of Comparative Examples and Examples of the Present Invention

| Property/ Example | Comparative Example No. 1 | Comparative Example No. 2 | Comparative Example No. 3 | Inventive Example No. 1 | Kennametal KC850 Grade |
|---|---|---|---|---|---|
| Mag. Sat. (gauss-cm$^3$/g cobalt) | 155 | 155 | 158 | 158 | 158 |
| $H_c$ (oersteds) | 146 | 142 | 148 | 149 | 160 |
| Hardness (Rockwell A) | 91.5 | 91.3 | 91.4 | 91.3 | 91.6 |
| Depth of Binder Enrichment ($\mu$m) | 32 | 40 | 42 | 45 | 20 |

The cutting insert blanks were then peripheral ground and honed so that in the resulting substrate there was cobalt enrichment on the rake faces and the flank faces did not have cobalt enrichment. The cutting insert blanks were then coated with a tri-phase coating according to U.S. Pat. No. 4,035,541. The base layer was titanium carbide applied via CVD to a thickness of 4.5 micrometers ($\mu$m). The intermediate layer was titanium carbonitride applied via CVD to a thickness of 3.5 $\mu$m. The top layer was titanium nitride applied via CVD to a thickness of 3.0 $\mu$m.

The turning performance for the comparative examples and the inventive example was done according to the following test procedure:

Workpiece Material: AISI 4340 Steel (300 BHN)

Turning conditions 450 surface feet per minute (sfm) [137.2 surface meters per minute] or 550 sfm [167.8 surface meters per minute], feed of 0.020 inch per revolution (ipr) [0.0508 centimeters per revolution] and 0.1 inch (0.254 centimeter) depth of cut (doc)

Coolant: TrimSol Regular (20%)

Insert Style SNG-433 with radius hone (0.003 inches) [0.0076 centimeters] edge preparation.

Insert Life Criteria

Maximum Flank Wear=0.030 inches (0.076 centimeters)

Uniform Flank Wear=0.015 inches (0.038 centimeters)

Chip=0.030 inches (0.076 centimeters)

Crater Wear (depth)=0.004 inches (0.010 centimeters)

Nose Wear=0.030 inches (0.076 centimeters)

Depth of Cut Notching=0.030 inches (0.076 centimeters)

The turning performance of the comparative examples and the inventive example was also done according to the following procedure:

Workpiece Material: AISI 1045 Steel (210 BHN)

Turning conditions 750 sfm (228.8 surface meters per minute)

0.020 ipr (0.0508 centimeters per revolution)

0.1 inch (0.254 centimeter) depth of cut (doc)

Coolant: TrimSol Regular (20%)

Insert Style SNG-433 with radius honed (0.003 inches) [0.0076 centimeters] edge preparation.

Insert Life Criteria

Maximum Flank Wear=0.030 inches (0.076 centimeters)

Uniform Flank Wear=0.015 inches (0.038 centimeters)

Chip=0.030 inches (0.076 centimeters)

Crater Wear (depth)=0.004 inches (0.010 centimeters)

Nose Wear=0.030 inches (0.076 centimeters)

Depth of Cut Notching=0.030 inches (0.076 centimeters)

The impact strength of the comparative examples and the inventive example was done according to the following slotted bar (41L50 steel) turning test procedure:

Speed: 350 sfm (106.8 surface meters per minute)

Depth of Cut=0.1 inches (0.254 centimeters)

Feed=the starting feed was 0.015 inches per revolution (0.038 centimeters per revolution) with the feed increased 0.005 inches per revolution (0.0127 centimeters per revolution) every 100 impacts until the test reached 800 impacts which was a feed of 0.050 inches per revolution (0.127 centimeters per revolution) or until breakage, whichever occurred first.

Table III below sets forth the test results for testing of Comparative Examples Nos. 1 through 4 and the Inventive Example No. 1.

TABLE III

Insert Life and Edge Strength Test Results for Comparative Examples No. 1 Through 3 and the Inventive Example No. 1

| Example/ Property | Porosity Rating | Edge Strength (# of Impacts) | 1045 Steel 750 sfm (minutes) | 4340 Steel 450 sfm (minutes) | 4340 Steel 550 sfm (minutes) |
|---|---|---|---|---|---|
| Comp. Ex. No. 1 | CO0 | 635 | 13.7 | 24.1 | 10.6 |
| Comp. Ex. No. 2 | CO6 | 800 | 10.7 | 20.7 | 9.5 |
| Comp. Ex. No. 3 | CO8 | 800 | 5.6 | 17.6 | 7.1 |
| "Kennametal KC850 ® Coated Cutting Insert | CO8 minimum | 800 | 5.3 | 18.75 | 7.2 |
| Inventive Ex. No. 1 | CO4 | 800 | 13.1 | 24.1 | 10.5 |

The porosity rating for Table III is done according to the ASTM Designation B 276–86, entitled "Standard Test Method for Apparent Porosity in Cemented Carbides." The depth of the binder enrichment was determined by optical examination of a cross-section of the specimen via a metallograph at a magnification of 1500×.

The edge strength sets forth the number of impacts until either breakage or the test was terminated at 800 impacts via the slotted bar test described above. The turning test results reflect the inserts tool life in minutes from the test procedures described above.

The data from Table III shows very clearly that the Inventive Example No. 1 has excellent slotted bar edge strength (800 impacts). It also demonstrated excellent tool life in the turning of 1045 and 4340 steels. The overall metal cutting properties of the Inventive Example No. 1 are superior to all of the other examples shown (i.e., Comparative Examples Nos. 1 through 3 and the "Kennametal KC850®" coated cutting insert).

More specifically, the edge strength of the Inventive Example No. 1 is equivalent to the edge strength of the higher carbon Comparative Examples Nos. 2 and 3, and superior to the edge strength of the lower carbon Comparative Example No. 1. Inventive Example No. 1 also has an edge strength that is equivalent to that of the higher carbon alloy "Kennametal KC850®" coated cutting insert.

Along with the excellent edge strength, the Inventive Example No. 1 also demonstrated superior 1045 steel tool life in comparison to the other high carbon examples. Inventive Example No. 1 had a tool life of 13.1 minutes in comparison with 10.7 minutes for Comparative Example No. 2, 5.6 minutes for Comparative Example No. 3, and 5.3 minutes for the "Kennametal KC850®" coated cutting insert. The 4340 steel tool life of the Inventive Example No. 1 is also superior to the tool life of the other (800 impact) edge strength higher carbon examples (e.g., Comparative Examples Nos. 2 and 3, and the "Kennametal KC850®" coated cutting insert). Although the 4340 and 1045 steel tool life was only equivalent to, or slightly lower than, the lower carbon Comparative Example No. 1, the Inventive Example No. 1 has superior edge strength in that it sustained 800 impacts verses 635 impacts for Comparative Example No. 1.

It is very apparent that the present invention presents a cutting insert with improved characteristics over the Comparative Examples Nos. 1 through 3, as well as the "Kennametal KC850®" coated cutting insert. These improved characteristics are especially apparent in conjunction with the impact strength and wear resistance demonstrated in the interrupted and continuous turning of steel as shown above.

All patents and other documents identified in this application are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A cutting insert comprising:

a rake face and a flank face, a cutting edge at the juncture of the rake face and the flank face;

the cutting insert having a coating and a substrate wherein the coating is adherently bonded to the substrate;

the substrate being a tungsten carbide-based cemented carbide having a bulk composition of between about 3 to about 12 weight percent cobalt, up to about 12 weight percent tantalum, up to about 6 weight percent niobium, up to about 10 weight percent titanium, and the balance comprising tungsten, nitrogen and carbon;

wherein the cobalt concentration being enriched in a zone of non-stratified cobalt enrichment beginning near and extending inwardly from a peripheral surface of the substrate, the enriched zone having a maximum cobalt concentration of between about 125 and 300 percent of the cobalt in the bulk substrate; and wherein the bulk substrate having a porosity of greater than C00 and less than or equal to C04.

2. The cutting insert of claim 1 wherein the substrate has a bulk composition comprising between about 5.6 and about 7.5 weight percent cobalt, between about 5.0 and about 5.5 weight percent tantalum, between about 1.7 and about 2.3 weight percent titanium, up to about 0.4 weight percent niobium, and the balance comprising tungsten and carbon and nitrogen.

3. The cutting insert of claim 1 wherein the enriched zone has a maximum cobalt content of between about 150 and about 300 percent of the cobalt in the bulk substrate.

4. The cutting insert of claim 1 wherein the enriched zone has a maximum cobalt content of between about 200 and about 300 percent of the cobalt in the bulk substrate.

5. The cutting insert of claim 1 wherein the zone of non-stratified cobalt enrichment extends to a depth of between about 40 micrometers and about 50 micrometers from the peripheral surface.

6. The cutting insert of claim 1 wherein the substrate has a bulk composition of about 5.8 weight percent cobalt, about 5.2 weight percent tantalum, about 2.0 weight percent titanium, and the balance comprising tungsten and carbon.

7. The cutting insert of claim 1 wherein the substrate is formed from sintering a consolidated mass of starting powders.

8. The cutting insert of claim 7 wherein the starting powders include titanium nitride.

9. The cutting insert of claim 7 wherein the starting powders include tantalum carbide.

10. The cutting insert of claim 7 wherein the starting powders include niobium carbide.

11. The cutting insert of claim 7 wherein the starting powders include tungsten carbide.

12. The cutting insert of claim 7 wherein the starting powders include carbon.

13. The cutting insert of claim 1 wherein the zone of cobalt enrichment extends to the peripheral surface of the substrate.

14. The cutting insert of claim 1 wherein the coating comprises a base layer adjacent to the surface of the substrate, an intermediate layer on the base layer, and an outer layer on the intermediate layer; and the base layer comprising one or more materials selected from the group consisting of titanium carbonitride and titanium nitride, the intermediate layer comprising one or more materials selected from the group consisting of titanium carbonitride, titanium nitride, titanium carbide, alumina, and titanium aluminum nitride, and an outer layer comprising one or more materials selected from the group consisting of titanium nitride, titanium carbonitride, titanium aluminum nitride, and alumina.

15. The cutting insert of claim 1 wherein the coating comprising one or more layers wherein the layers are applied by one or more of physical vapor deposition, chemical vapor deposition, and moderate temperature chemical vapor deposition.

16. A coated cutting insert comprising:

a rake face and a flank face, a cutting edge at the juncture of the rake face and the flank face;

the cutting insert having a substrate and a coating scheme wherein the coating scheme is adherently bonded to the substrate;

the substrate being a tungsten carbide-based cemented carbide having a bulk composition of between about 5.6 weight percent to about 6.4 weight percent cobalt, between about 2.5 weight percent and about 3.3 weight percent tantalum, between about 1.5 weight percent and about 2.5 weight percent titanium, up to about 1.0 weight percent niobium, and the balance comprising tungsten, nitrogen and carbon;

wherein the cobalt concentration being enriched in a zone of non-stratified cobalt enrichment beginning near and extending inwardly from a peripheral surface of the substrate, the enriched zone having a maximum cobalt concentration of between about 125 and 300 percent of the cobalt in the bulk substrate; and wherein the bulk substrate having a porosity of greater than C00 and less than or equal to C04.

17. The coated cutting insert of claim 16 wherein the coating scheme comprising a base layer next to the substrate, an intermediate layer next to the base layer, and an outer layer next to the intermediate layer; and the base layer comprising one or more materials selected from the group consisting of titanium carbonitride and titanium nitride, the intermediate layer comprising one or more materials selected from the group consisting of titanium carbonitride, titanium nitride, titanium carbide, alumina, and titanium aluminum nitride, and an outer layer comprising one or more materials selected from the group consisting of titanium nitride, titanium carbonitride, titanium aluminum nitride, and alumina.

18. The coated cutting insert of claim 16 wherein the zone of non-stratified cobalt enrichment extends to a depth up to about 50 micrometers.

19. The coated cutting insert of claim 16 wherein the substrate comprises about 6.0 weight percent cobalt, about 2.9 weight percent tantalum, about 2.0 weight percent titanium, about 0.6 weight percent niobium, and the balance being tungsten, carbon and nitrogen.

20. A coated cutting insert comprising:

a rake face and a flank face, a cutting edge at the juncture of the rake face and the flank face;

the cutting insert having a substrate formed by heat treating a consolidated mass of starting powders;

the cutting insert further having a coating scheme wherein the coating scheme is adherently bonded to the substrate, the coating scheme comprising a plurality of layers wherein a first layer comprising titanium carbonitride, a second layer comprising alumina, and a third layer comprising titanium nitride;

the substrate being a tungsten carbide-based cemented carbide having a bulk composition of between about 5.6 weight percent to about 6.4 weight percent cobalt, between about 2.5 weight percent and about 3.3 weight percent tantalum, between about 1.5 weight percent and about 2.5 weight percent titanium, up to about 1.0 weight percent niobium, and the balance comprising tungsten, nitrogen and carbon;

wherein the cobalt concentration being enriched in a zone of non-stratified cobalt enrichment beginning near and extending inwardly from a peripheral surface of the substrate, the enriched zone having a maximum cobalt concentration of between about 125 and 300 percent of the cobalt in the bulk substrate; and wherein the bulk substrate having a porosity of greater than C00 and less than or equal to C04.

21. The cutting insert of claim 1 wherein the bulk substrate having a porosity of C04.

22. The cutting of claim 1 wherein the coating includes a plurality of layers wherein the layers include a base layer next to the substrate wherein the base layer comprises titanium nitride, an outer layer wherein the outer layer comprises titanium nitride, and at least one intermediate layer between the base layer and the outer layer.

23. The cutting insert of claim 22 wherein the intermediate layer comprises titanium carbonitride applied by moderate temperature chemical vapor deposition.

24. The cutting insert of claim 22 wherein the intermediate layer comprises titanium carbonitride and titanium carbide.

25. The cutting insert of claim 22 wherein the intermediate layer comprises alumina.

26. The coated cutting insert of claim 16 wherein the bulk substrate has a porosity of C04.

27. The coated cutting insert of claim 16 wherein coating scheme includes a plurality of layers wherein the layers include a base layer next to the substrate wherein the base layer comprises titanium nitride, an outer layer wherein the outer layer comprises titanium nitride, and at least one intermediate layer between the base layer and the outer layer; and the intermediate layer being selected from the group consisting of titanium carbonitride applied by moderate temperature chemical vapor deposition or titanium carbonitride and titanium carbide or alumina.

28. The coated cutting insert of claim 20 wherein the bulk substrate has a porosity of C04.

* * * * *